US005503648A

United States Patent [19]

Wiemann

[11] Patent Number: 5,503,648

[45] Date of Patent: Apr. 2, 1996

[54] PROCESS FOR THE PRODUCTION OF GRINDING TOOLS AND TOOLS PRODUCED THEREBY

[75] Inventor: Hans-Joachim Wiemann, Hamburg, Germany

[73] Assignee: Firma Mecano Vorrichtungsbau GmbH, Hamburg, Germany

[21] Appl. No.: 302,848

[22] PCT Filed: Dec. 23, 1993

[86] PCT No.: PCT/EP93/03677

§ 371 Date: Dec. 9, 1994

§ 102(e) Date: Dec. 9, 1994

[87] PCT Pub. No.: WO94/15753

PCT Pub. Date: Jul. 21, 1994

[30] Foreign Application Priority Data

Jan. 14, 1993 [DE] Germany ..... 43 00 722.8

[51] Int. Cl.[6] ..... B24D 18/00

[52] U.S. Cl. ..... 51/293; 51/295; 51/298

[58] Field of Search ..... 51/293, 295, 298

[56] References Cited

U.S. PATENT DOCUMENTS

| | | | |
|---|---|---|---|
| 3,415,635 | 12/1968 | Hallewell | 51/295 |
| 4,634,453 | 1/1987 | Hay et al. | 51/295 |
| 5,094,671 | 3/1992 | Hall et al. | 51/295 |

FOREIGN PATENT DOCUMENTS

| | | | |
|---|---|---|---|
| 0204195 | 12/1986 | European Pat. Off. | B24D 5/02 |
| 0407069 | 1/1991 | European Pat. Off. | B24D 18/00 |
| 2845386 | 4/1980 | Germany . | |
| 2224976 | 9/1990 | Japan | B24D 27/06 |

*Primary Examiner*—Deborah Jones

*Attorney, Agent, or Firm*—Michael J. Striker

[57] ABSTRACT

The subject of the invention is a process for the production of grinding tools which have a basic body carrying an abrasive coating. The abrasive coating has hard-material grains, such as diamond grains, which are held in a bond. In order to simplify the production process, provision is made, after the abrasive coating (8) has been applied to the basic body (2), for the tool (1), vacuum-packaged in a foil (10), to be hot-pressed isostatically in an autoclave. This avoids the need to use special hardened or ground press molds made of high-quality material steels.

9 Claims, 1 Drawing Sheet

PROCESS FOR THE PRODUCTION OF GRINDING TOOLS AND TOOLS PRODUCED THEREBY

BACKGROUND OF THE INVENTION

The subject of the invention is a process for the production of grinding tools having a basic body carrying an abrasive coating which consists of super-abrasives, such as diamond grains or grains of cubic-crystalline boronitride arranged finely distributed in a bond.

In the industrial production technology, resin-bonded grinding wheels in particular are used for the grinding of tools and are equipped with hard and wear-resistant materials, such as, for example, hard metals or ceramic materials. In addition, resin-bonded grinding wheels are employed for the machining of high-alloy steels. For this purpose, the hard-material granulation of grinding wheels of this type consist of natural or synthetic diamond or cubic-crystalline boronitride as an abrasive. Usually duroplastic resins, such as phenol resins, are used as bonds of such super-abrasives in resin-bonded grinding wheels and also contain, in addition to the hard-material grains arranged finely distributed, so-called fillers which contributed to a stabilization of the plastic structure and its elasticity. Such fillers consist, for example, of Silicon carbide in different grain sizes. Melamine resins, polyamides, polyimides and polisulphones can also be employed as a bond.

For the production of grinding wheels or, in general, grinding tools by the use of materials of this kind, according to known processes the resins, fillers and super-abrasives are introduced as mixtures into press molds made of hardened steel and are pressed under high pressure and appropriate temperatures onto corresponding basic bodies or abrasive-carriers, in order to convert them into a hardened duroplastic state.

For this purpose, where phenol resins, melamine resins and similar resins are concerned, press temperatures of, for example, 180°–200° C. and pressures of 1,500–3,000 Newton/cm$^2$ are adopted. In contrast, for polyimide resins, even higher temperatures, namely up to 350° C., and higher press pressures, such as up to 4,000 Newton, are necessary.

This known method of producing grinding wheels involves a high outlay, in as much as it requires the use of hardened and ground press molds which, as a result of the wall friction with super-abrasives, undergo continuous wear during their use, so that they are suitable only for a small number of pressings. Another disadvantage is the need to provide a press mold which is adapted to the particular grinding-wheel dimension.

Peripheral grinding wheels with a coating depth of, for example, 2 mm and with a length of abrasive coating of several hundred millimeters cannot be produced from one piece by this known process, but have to be assembled from a plurality of individual grinding wheels. This presents the problem of connection at the seams which, as a rule, should be non-parallel in the circumferential direction, because otherwise, for example during the so-called plunge-cut grinding, visible grinding traces occur on the workpieces to be machined.

Finally, a drawback of the known processes is to be seen in that only a very small number of grinding wheels can be produced under a single press in one pressing operation.

SUMMARY OF THE INVENTION

The object of the invention is to make the process for the production of grinding tools more economical. For this purpose, according to the invention, provision is made, after the abrasive coating has been applied to the basic body, for the tool, vacuum-packaged in a foil, to be hot-pressed isostatically in an autoclave.

The production process according to the invention affords, in comparison with previously known processes, the particular advantage that there is no need to use hardened and ground press molds made of high-alloy material steels, since, in the process according to the invention, the basic bodies can be prepared in such a way that the abrasive coatings, after being completed, correspond to the required dimensions. This is true particularly when depressions are preformed in the basic body for the reception of the abrasive coating and when the latter is exposed, after the hot-pressing, as a result of the partial dressing of the basic body and the dimensionally accurate grinding of the coating. For this purpose, the preformed depressions have a volume which makes it possible to introduce the resins to be processed, together with their fillers and super-abrasives, in a pressureless manner to the desired thickness or height. In order, at the same time, to guarantee a complete filling, it is expedient to enrich the coating, which is dried per se and which consists of the resins, fillers and hard-material grains, with a small quantity of liquid resin, in such a way that it is converted into a viscous dough-like state.

To allow for the fact that phenol resins and other types of resin, such as polyimides, give off gases during their hardening, a pretreatment can take place, before the hot-pressing in the autoclave, in the manner of a precompaction of the coating and a degassing in a furnace. For this purpose, the following process steps can preferably be carried out:

In the first place, the basic bodies, together with their coatings introduced into the depressions, are welded into plastic foils, with simultaneous evacuation to a vacuum of, for example, $10^{-1}$ Torr. The welded tools can then at the same time be cold-compacted in the most diverse shapes and sizes in autoclaves by the use of a pressure of, for example, 3,000 Newton/cm$^2$. It is thus possible, even in the first process step, to utilize the advantage of cold-pressing or precompacting a plurality of grinding tools of different types and sizes in a single operation in an autoclave.

In a second subsequent operation, after the removal of the foils the corresponding tools are introduced into an electrically heated circulating-air furnace and degassed in a cycle of approximately 2–3 hours at a temperature of approximately 90°, since an exhalation of gas from the resins occurs at this temperature.

In a third process step, the degassed and precompacted coatings or tools are once more welded into foils and again evacuated to a vacuum of approximately $10^{-1}$ Torr, in order thereafter, in a further pressing operation, to be hot-pressed isostatically in an autoclave by the use of pressure and temperature, the work being carried out at pressures of 1,500–4,000 Newton/cm$^2$ and at a temperature of 180°–350° C., depending on the type of resin in the bond.

After the isostatic hot-pressing, the tools are finish-machined mechanically, specifically particularly by finish-turning and regrinding in the region of the abrasive coating, for the purpose of exposing the abrasive coating. This finish-machining is comparable to the machining of grinding tools which are produced according to the known processes by the use of hardened molds.

The particular advantages of the processes according to the invention are, therefore, especially the avoidance of the use of high-quality press molds and consequently a considerable cost reduction. Since, at the same time, grinding wheels of any shape and in relatively large quantities can be both prepressed and finally hot-pressed in an autoclave, production can be carried out in a particularly flexible way. Even coating dimensions in the ratio of 1:100 to 1:400 for peripheral grinding wheels present no problem, because, in the process according to the invention, abrasive coatings of this type can be produced in one piece. Finally, quality is also improved, since no wall friction which impairs quality occurs during prepressing and finish-pressing.

Moreover, the execution of the process according to the invention can be further simplified, in that the coatings, for their temporary retention, are fastened to the basic body by means of an adhesive, with which the abovementioned depressions are to be filled in, a plastic based on phenol resin preferably being considered as an adhesive.

It is also an object of the present invention to provide a grinding tool in which the abrasive coating is hot-pressed isostatically in a vacuum on the basic body.

Also, the abrasive coating can be arranged in a preformed depression of the basic body.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
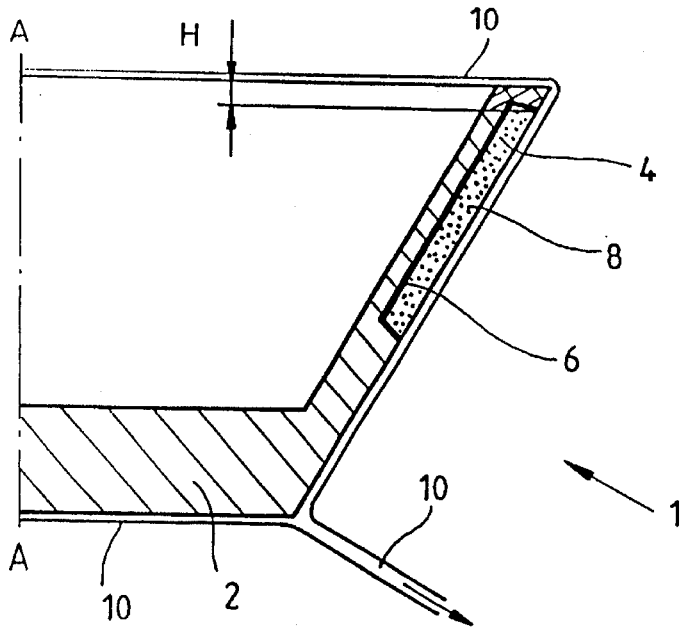
FIG. 1 shows a cup grinding wheel in the intermediate stage of production.

The cup grinding wheel 1, reproduced partially and in section in FIG. 1, possesses a basic body 2 which consists of a synthetic resin or a metal or of a combination of the two. On its outside, the basic body 2 is provided with an annular depression 4 which is worked in by turning and which extends near to the upper edge of the basic body 1. The abrasive coating 8 is introduced into this depression 3 in pasty form or in a dough-like state. The abrasive coating 8 consists of the super-abrasives which are finely distributed in a bond consisting of phenol resin, to which a filler or filling material is added, for example consisting of silicon carbide or aluminium oxide.

The basic body 2 together with the coating 6 is surrounded by a tube-like plastic foil, such as polyimide, which is evacuated. The foil 10 protects the coating 8 against the penetration of the gaseous pressing medium of the autoclave into the pores of the coating during a pressing, specifically both during cold-pressing and during isostatic hot-pressing. The arrangement of the foil and the evacuation therefore first take place before cold-pressing in an autoclave. This drying is subsequently to be carried out in a furnace, and the first foil must be removed again for this purpose. For isostatic hot-pressing in an autoclave, an enveloping of the basic body with a foil 10 and an evacuation of the foil tube are carried out once more.

During the curing of the synthetic resin or the bonding of the diamond grains under an overpressure of the order of 3,000 Newton/cm$^2$ and a temperature of approximately 200° C., the coating is compressed to a smaller height, as indicated in FIG. 1.

After the isostatic hot-pressing, a remachining of the basic body for the purpose of exposing the abrasive coating 8. For this, the upper edge region of the tool 1 is dressed over the height "H". Furthermore, a remachining of the abrasive coating exposed on the outside can be carried out by grinding.

Figure 2:
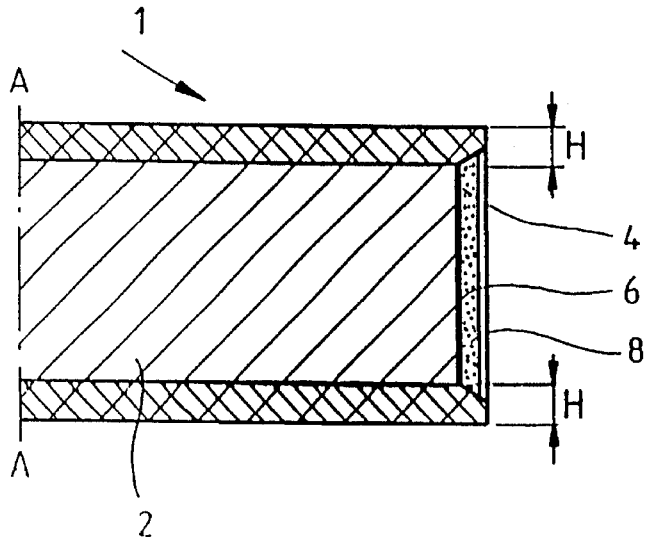
FIG. 2 shows, in section, a peripheral grinding wheel before and after final machining.

The production of a peripheral grinding wheel according to FIG. 2 takes place in the same way, so that the peripheral grinding wheel according to FIG. 2 can be produced simultaneously with a cup grinding wheel according to FIG. 1.

In the peripheral grinding wheel according to FIG. 2, the basic body 2 is provided on its outer circumference with an annular depression 4, into which an adhesive is introduced for a better retention of the coating 8 applied thereafter. This coating 8 is introduced to the full height of the depression 4. As a result of the pressing under high pressure, its thickness or height decreases to the extent reproduced in FIG. 2. After the production of the grinding wheel, an exposure of the abrasive coating 8 is carried out as a result of a dressing of the projecting portions of the basic body 2 which are reproduced by double hatching in FIG. 2.

Figure 3:
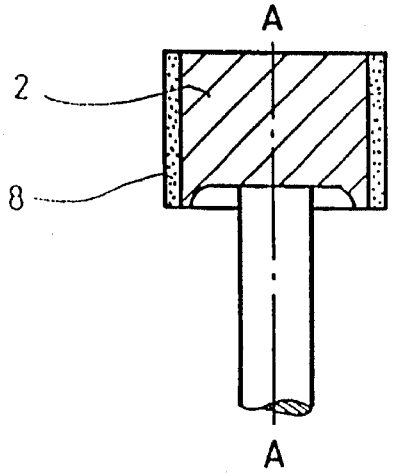
FIG. 3 shows a grinding pencil in axial section.

FIG. 3 shows a grinding pencil which is produced in a similar way and which rotates about the axis A—A. All these three abovementioned exemplary embodiments can be produced simultaneously by the above-described process, without the need for separate press molds and, for example, hydraulic presses. All that is needed for use is a commercially available autoclave, inside which both a high pressure and a high temperature are to be generated according to the particular requirements. In other words, various grinding tools of different sizes and different coating thicknesses or coating lengths can be produced simultaneously, without the need to manufacture and use special press molds.

I claim:

1. A process for producing a grinding tool having a basic body which includes an abrasive coating comprising hard-material grains selected from the group consisting of diamond grains and grains of cubic-crystalline boronitride uniformly distributed in a bond, the process comprising the steps of applying the abrasive coating to the basic body; vacuum-packaging the tool including the basic body with the applied abrasive coating in a foil; and hot-pressing the vacuum-packaged tool isostatically in an autoclave.

2. A process as defined in claim 1; and further comprising the step of degassing the abrasive coating in a furnace before said vacuum-packaging.

3. A process as defined in claim 1, wherein said vacuum-packaging includes cold-precompacting of the abrasive coating isostatically in a first vacuum-packaging, thereafter degassing the abrasive coating in a furnace, and then vacuum-packaging again.

4. A process as defined in claim 1, wherein said applying includes introducing the abrasive coating into preformed depressions on the basic body; and further comprising the step of, after the isostatic hot-pressing, exposing the abrasive coating by a partial dressing of the basic body and regrinding of the coating.

5. A process as defined in claim 1 wherein a liquid resin is added to the abrasive coating in an amount sufficient to convert said coating to a viscous dough consistency.

6. A process as defined in claim 1, wherein said abrasive coating is applied to the basic body with an adhesive.

7. A process as defined in claim 1, wherein said hot-pressing of the coating in an autoclave is performed under a pressure of 1,500–4,000 Newton/cm$^2$.

8. A grinding tool, comprising a basic body and an abrasive coating comprising hard-material grains selected from the group consisting of diamond grains and grains of cubic-crystalline boronitride uniformly distributed in a bond, said abrasive coating being hot-pressed isostatically in a vacuum on said basic body.

9. A grinding tool as defined in claim 8, wherein said basic body has a preformed depression, said abrasive coating being arranged in said preformed depression of said basic body.

* * * * *